US008651463B2

(12) United States Patent
Mao-Cheia et al.

(10) Patent No.: US 8,651,463 B2
(45) Date of Patent: Feb. 18, 2014

(54) BALUSTRADE

(75) Inventors: Jose T. Mao-Cheia, Port Elizabeth (ZA); Fredrick E. Basson, Port Elizabeth (ZA)

(73) Assignee: Jose Teixeira Mao-Cheia, Humerwood, Port Elizabeth (ZA)

( * ) Notice: Subject to any disclaimer, the term of this patent is extended or adjusted under 35 U.S.C. 154(b) by 0 days.

(21) Appl. No.: 12/989,551

(22) PCT Filed: Apr. 24, 2009

(86) PCT No.: PCT/IB2009/051700

§ 371 (c)(1), (2), (4) Date: Feb. 9, 2011

(87) PCT Pub. No.: WO2009/130687

PCT Pub. Date: Oct. 29, 2009

(65) Prior Publication Data

US 2011/0133146 A1 Jun. 9, 2011

(30) Foreign Application Priority Data

Apr. 25, 2008 (ZA) ..... 2007/09189

(51) Int. Cl.
*E04H 17/14* (2006.01)

(52) U.S. Cl.
USPC ..... 256/65.04; 403/292; 403/305

(58) Field of Classification Search
USPC ..... 403/174, 175, 195, 396; 256/65.01–65.05, 65.08, 68, 65.14, 59; 248/540, 541, 218.4, 230.1
See application file for complete search history.

(56) References Cited

U.S. PATENT DOCUMENTS

| | | | | | |
|---|---|---|---|---|---|
| 271,797 | A | * | 2/1883 | Cook | 403/191 |
| 340,263 | A | * | 4/1886 | Weber | 256/68 |
| 462,412 | A | * | 11/1891 | Poindexter | 256/65.05 |
| 1,261,213 | A | * | 4/1918 | Clay | 403/233 |
| 2,150,651 | A | * | 3/1939 | Ewing | 403/201 |
| 2,611,658 | A | * | 9/1952 | McGuire | 403/195 |
| 2,764,438 | A | * | 9/1956 | Haviland | 403/234 |
| 2,797,968 | A | * | 7/1957 | Le Febvre et al. | 403/191 |
| 2,835,475 | A | * | 5/1958 | Enghauser | 256/22 |
| 3,522,960 | A | * | 8/1970 | Moore | 403/234 |
| 3,633,250 | A | * | 1/1972 | Romney | 403/76 |
| 3,972,639 | A | * | 8/1976 | Lening | 403/191 |
| 4,526,348 | A | * | 7/1985 | Cammack | 256/65.06 |
| 4,667,505 | A | * | 5/1987 | Sharp | 73/40.5 R |
| 4,854,548 | A | | 8/1989 | Wylie | |
| 4,892,292 | A | * | 1/1990 | Russell | 256/66 |
| 4,915,535 | A | * | 4/1990 | Willetts | 403/191 |
| 4,921,370 | A | * | 5/1990 | Handler et al. | 403/234 |

(Continued)

FOREIGN PATENT DOCUMENTS

| | | | |
|---|---|---|---|
| AU | 2008202014 | A1 | 11/2008 |
| DE | 2425506 | A1 | 12/1975 |
| DE | 29508450 | U1 | 8/1995 |
| GB | 2387394 | A | 10/2003 |

*Primary Examiner* — Joshua Kennedy
(74) *Attorney, Agent, or Firm* — Novak Druce Connolly Bove + Quigg LLP

(57) ABSTRACT

A balustrade and a method of manufacturing it are provided. The balustrade has a number of upright posts that are anchored in a substrate and has rails that extend between the posts. The rails are attached to the posts with attachment formations, by way of a press fit, so that the balustrade can be assembled without any welding on site.

4 Claims, 6 Drawing Sheets

(56) References Cited

U.S. PATENT DOCUMENTS

| | | | | |
|---|---|---|---|---|
| 4,930,754 | A * | 6/1990 | Caron et al. | 256/65.05 |
| 5,015,116 | A * | 5/1991 | Nardone et al. | 403/28 |
| 5,961,242 | A * | 10/1999 | Leone | 403/234 |
| 6,203,233 | B1 * | 3/2001 | Stanley | 403/28 |
| 6,283,457 | B1 * | 9/2001 | Venegas, Jr. | 256/65.05 |
| 7,191,988 | B2 * | 3/2007 | Kim et al. | 248/68.1 |
| 2004/0041141 | A1 * | 3/2004 | Cannon | 256/65.05 |
| 2004/0041142 | A1 * | 3/2004 | Morgan et al. | 256/65.08 |
| 2007/0034846 | A1 * | 2/2007 | Ratanasiriwilai | 256/65.01 |
| 2009/0184303 | A1 * | 7/2009 | Jones et al. | 256/67 |

* cited by examiner

BALUSTRADE

CROSS REFERENCE TO RELATED APPLICATIONS

This application is a National Phase filing under 35 U.S.C. §371 of PCT/IB2009/051700 filed on Apr. 24, 2009; and this application claims priority to Application No. 200709189 filed in South Africa on Apr. 25, 2008 under 35 U.S.C. §119; the entire contents of all are hereby incorporated by reference.

FIELD OF THE INVENTION

This invention relates to balustrades. In particular, the present invention relates to a method of manufacturing a balustrade that can be conveniently assembled on site.

BACKGROUND TO THE INVENTION

Balustrades are features in buildings that comprise of a number of upright posts (stanchions or "balusters") which support a coping or handrail along their upper ends and which often include a so-called "infill" between posts, such as a number of intermediate cross-bars, vertical slats or glass panels. Historically, a wide variety of materials have been used to manufacture balustrades, but the present invention is concerned with balustrades made of metal, e.g. stainless steel, although the features of the present invention can also be used with different materials.

Conventional steel balustrades are typically manufactured by welding the different components together. This can be done by completing all the welding off site and installing the entire balustrade by anchoring it to the adjacent structure, e.g. by bolting it to the adjacent floor and/or walls, but this either requires the adjacent structure to have the exact dimensions to which the balustrade has been made (which is practically very difficult to achieve) or requires construction of the adjacent structure with the balustrade already in place, thus exposing the balustrade to possible damage during construction.

More typically, balustrades are part manufactured off site by making the posts and are then completed on site. This is done by bolting the posts to the adjacent structure, welding the top rail to the posts, drilling holes in the posts, passing steel bars through the drilled holes and welding them in position to form intermediate cross-bars. This manufacturing method holds a number of disadvantages, e.g. in that the posts usually need to be aligned and this is done by placing shims or spacers underneath their bases. Further, the attachment of the posts typically requires them to be bolted to the adjacent structure, leaving unsightly bolt heads visible. Further, the requirement for welding on-site, means that expensive equipment and skilled artisans are required on site, increasing the cost of the balustrade and the cost is increased further if the welds need to be finished to be aesthetically acceptable, e.g. by polishing the welds and adjacent heat affected metal.

The present invention seeks to overcome the disadvantages of existing balustrades and their manufacture and in particular, to provide for the cost effective manufacture of balustrades that are aesthetically pleasing and that can be installed without the need for welding on site.

SUMMARY OF THE INVENTION

According to one aspect of the present invention there is provided a method of manufacturing a balustrade, said method comprising:

providing a plurality of posts;

attaching the posts to a substrate, each with an upright orientation; and installing at least one rail by attaching it to the posts;

wherein each rail is attached to the posts by providing attachment formations and press-fitting the posts, attachment formations and rail together, at least in part.

The term "press fit" refers in this specification to any interference fit between two objects and is not subject to quantified limits, i.e. it does not exclude a shrink fit or other fits that require more or less interference than what strictly meets the definition of a "press fit".

The rail may be a top rail of the balustrade, in which case the attachment formations may be assembled and attached to the upper end of the post, e.g. by means of a fastener, and the top rail may be attached to the attachment formations by press-fitting it onto the attachment formations. The top rail may be attached to the attachment formations by pressing it into a recess defined in the attachment formations and/or by receiving a lateral protuberance of the attachment formations inside a recess defined in the rail.

The rail may be an intermediate rail of the balustrade, in which case the attachment formations may be assembled to grip one of the posts at a position intermediate its ends and to grip an end of at least one intermediate rail, wherein the attachment formations grip the post and the intermediate rail with a press fit.

The attachment formations may include at least one clamp and at least one lock and the step of attaching the intermediate rail to the post may include positioning the clamp to grip the post and the end of the intermediate rail and may include sliding the lock onto the clamp with a press fit, to lock the clamp in gripping engagement with the post and the intermediate rail. Preferably, two clamps may be positioned on opposing sides of the post, to grip the ends of two intermediate rails on opposing sides of the post and two locks may be slid onto the clamps with a pres fit, to lock the clamps in their gripping engagement. The clamp may have a protuberance and the step of sliding the lock onto the clamp may include sliding the lock over the protuberance.

The method may include attaching the posts to the substrate by:

providing a plurality of anchor formations;

attaching the anchor formations to a substrate; and attaching a post to each anchor formation in a generally upright orientation;

wherein each anchor formation includes a spigot formation and is attached to the substrate with its spigot formation extending upwardly and the posts are attached to the anchor formations by attaching one end of the post to the spigot formation with a press fit.

Each post may be attached to its associated anchor formation by sliding the end of the post over the spigot formation and receiving the spigot formation in a recess defined in the post, with a press fit. Alternatively, or in addition, each post may be attached to its associated anchor formation by sliding the end of the post into a recess defined in the spigot formation, with a press fit.

According to another aspect of the present invention there is provided a balustrade, which comprises:

a plurality of upstanding posts; and at least one rail extending between the posts;

wherein the balustrade includes attachment formations and the post, rail and attachment formations are attached together, at least in part, with a press fit.

The balustrade may include at least one rail and attachment formations, the post, rail and attachment formations being fitted together, at least in part, with a press fit.

The rail may be a top rail of the balustrade, in which case the attachment formations may be fitted to the upper end of the post, e.g. by means of a fastener, and the rail may be fitted to the attachment formations with a press-fit. At least one of the rail and the attachment formations may define a recess, e.g. it may be hollow, with the other one of these components fitted inside the recess with a press fit. The attachment formations may include a protuberance that is receivable inside a recess defined in the end of the rail, with a press fit.

The rail may be an intermediate rail of the balustrade, in which case the attachment formations may extend at least part around the post at a position intermediate its ends and at least part around an end of at least one intermediate rail, with a press fit.

The attachment formations may include at least one clamp and at least one lock, with the clamp in engagement with the post and the intermediate rail with a press fit and with the lock extending at least part around the clamp with a press fit, to lock it in its gripping engagement with the post and the intermediate rail. Preferably, the attachment formation includes two clamps on opposing sides of the post and two locks fitted on the clamps with a press fit, with the clamps gripping the ends of two intermediate rails on opposing sides of the post with a press fit. The clamp may have a protuberance, with the lock extending over the protuberance with a press fit.

The balustrade may include a plurality of anchor formations, each attached to a substrate; and the lower end of each posts may be attached to one of the anchor formations, each anchor formation including an upwardly extending spigot formation and each post being attached to the spigot formation of its anchor formation with a press fit Each post may define a recess at its lower end, e.g. each post may be a hollow cylindrical tube, with its associated spigot formation fitted inside the recess with a press fit. Alternatively, each spigot formation may define a recess and the lower end of its associated post may be fitted inside the recess of the spigot formation with a press fit.

The invention extends to a kit for manufacturing a balustrade according to the method as described herein above and/or for manufacturing a balustrade as described herein above.

BRIEF DESCRIPTION OF THE DRAWINGS

For a better understanding of the present invention, and to show how the same may be carried into effect, the invention will now be described by way of non-limiting example, with reference to the accompanying drawings in which.

DETAILED DESCRIPTION OF THE DRAWINGS

Figure 1:
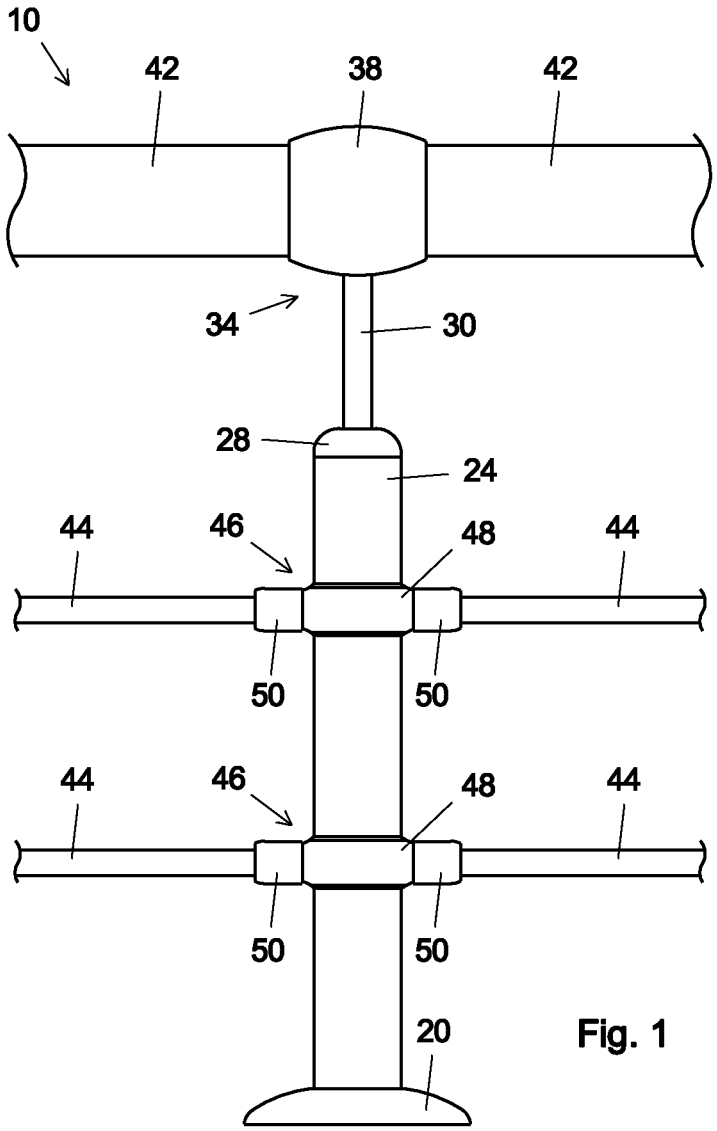
FIG. 1 is a diagrammatic side elevation of part of a balustrade in accordance with the present invention.

Referring to the drawings, a balustrade in accordance with the present invention is generally indicated by reference numeral 10.

Referring to FIGS. 1 to 4, the balustrade 10 in accordance with a first embodiment of the invention is manufactured by attaching a number of anchor formations 12 to a substrate on which the balustrade is to be installed, such as a concrete floor or the like. Each anchor formation 12 includes a base plate or flange 14 defining a number of holes 16 and a spigot 18 in the form of a hollow tube that has been pre-welded to the flange. The flange 14 is bolted tightly to the substrate with bolts extending through the holes 16 with the spigot 18 extending upwardly. A domed cover plate 20 with an aperture 22 is fitted loosely over the flange 14 to cover the heads of the bolts, with the spigot 18 extending through the aperture 22. A narrow space is defined between the spigot 18 and an inner circumference of the aperture 22.

A number of posts 24 are provided each in the form of a hollow tube with its upper end closed off and with a short threaded bar 26 extending coaxially upwardly from the top of the post. The closure of the upper ends of the posts 24 and the fitting of the threaded bars 26 are done by welding, before the posts are brought to site. If required, e.g. if the substrate is very uneven, one or more of the posts 24 can be shortened by cutting them at their lower ends, although this would not be required if the substrate is generally even. Each post 24 is attached to its associated anchor formation 12 by sliding the lower end of the post over the spigot 18, which is received inside the cavity of the post, with a press fit. The outer circumference of the spigot 18 and the inner circumference of the post 24 are dimensioned to ensure that the interference between these two components is sufficient to hold the post very firmly in place on the spigot 18.

When the post 24 has been pressed onto the spigot 18, its lower end is received inside the aperture 22 of the cover plate 20 with a press fit, which serves to keep the cover plate in position.

Once the post 24 has been fitted in an upright orientation onto the spigot 18 of its anchor formation 12, a domed cap 28 is fitted over its upper end and an extension or pin 30 is fitted onto the threaded bar 26 to extend coaxially upwardly from the post. The cap 28 is shaped and dimensioned to cover the closure of the upper end of the post 24 and defines an aperture 32 through which the lower end of the pin 30 is receivable with a press fit, to hold the cap in place. The cap 28, like the cover plate 20, performs the function of covering underlying parts in an aesthetically acceptable manner.

The pin 30 forms part of an upper assembly 34 of attachment formations, which further includes a cylindrical joining tube 36, a housing 38 and a fastener in the form of a bolt 40. As can best be seen in FIG. 4, the tube 36 is dimpled outwardly and the housing 38 is dimpled inwardly, each with an aperture through which the bolt 40 is passed from the inside, to be screwed into a threaded recess in the upper end of the pin 30, which fits snugly in the dimple of the housing 38. The bolt 40 thus holds the joining tube 36 and housing 38 firmly in position on top of the pin 30 in a concentric arrangement, while the respective dimples of the joining tube and housing cause them to be spaced apart with a generally annular space or recess defined between them. The ends of the joining tube 36 protrude laterally from the housing 38.

To install a top rail 42 of the balustrade 10, sections of cylindrical tube that form the top rail are slid over the protruding ends of the joining tube 36 (i.e. with the ends of the joining tube received inside the recesses formed by the hollow insides of the top rail 42) and the ends of the top rail 42 are received in the annular recess between the joining tube 36 and housing 38. These components are dimensioned such that there is a press fit between the joining tube 36 and the top rail 42, so that the top rail 42 is firmly attached to the upper assembly 34.

The balustrade 10 is further provided with an infill such as intermediate rails or cross bars 44 that extend between adjacent posts 24. This is done by providing appropriate lengths (slightly less than the distances between adjacent posts) of solid bar to form the cross bars 44 and attaching the cross bars to the posts 24 by using an intermediate assembly 46 of attachment formations, including clamps 48 and locks in the form of short, cylindrical lock rings 50. Each clamp 48 comprises of a three-dimensionally shaped sheet of metal that includes narrow, part-cylindrical sections 52 at its two ends and a wider curved section 54 in the middle.

Two cross bars 44 are positioned generally in alignment on opposing sides of the post 24 at any desired height intermediate the ends of the post. The clamps 48 are positioned on opposite sides of the post 24 and of the ends of the cross bars 44 facing the post, with the post received in the curvatures of the wider curved sections 54 and with the ends of the cross bars 44 received in the narrow sections 52. Each of the lock rings 50 is slid along one of the cross bars 44 over the two narrow sections 52 of the clamps 48 in which the end of that cross bar is received. The components are shaped such that there is a press fit between the lock ring 50 and the narrow ends 52 of the clamps 48, such that the clamps are pressed very tightly together at their ends, to grip the ends of the cross bars 44 between those ends very tightly. Further, the curvatures of the curved sections 54 of the clamps 48 are such that they grip the circumference of the post 24 very tightly when the lock rings 50 are press-fitted onto the narrow sections 52.

The fact that the cross bars 44 can be attached to the posts 24 practically anywhere intermediate the lengths of the posts without the need to drill holes in the posts, allows versatility in that the numbers and spacing of the cross bars can be varied to suit different customers, without the need for modification of any of the components of the balustrade. However, in some instances, holes can be drilled in the posts 24 into which the ends of the cross bars 44 can extend—preferably before the components are brought to site. The purpose of inserting the ends of the cross bars 44 into the holes is merely to ensure that the cross bars are installed at the correct height, without need to measure the heights where the attachment formations 46 need to be fitted. Only one hole needs to be drilled into the post 24 for each assembly 46, as the other cross bar 44 will be held at the correct height by the clamps 48.

Figure 2:
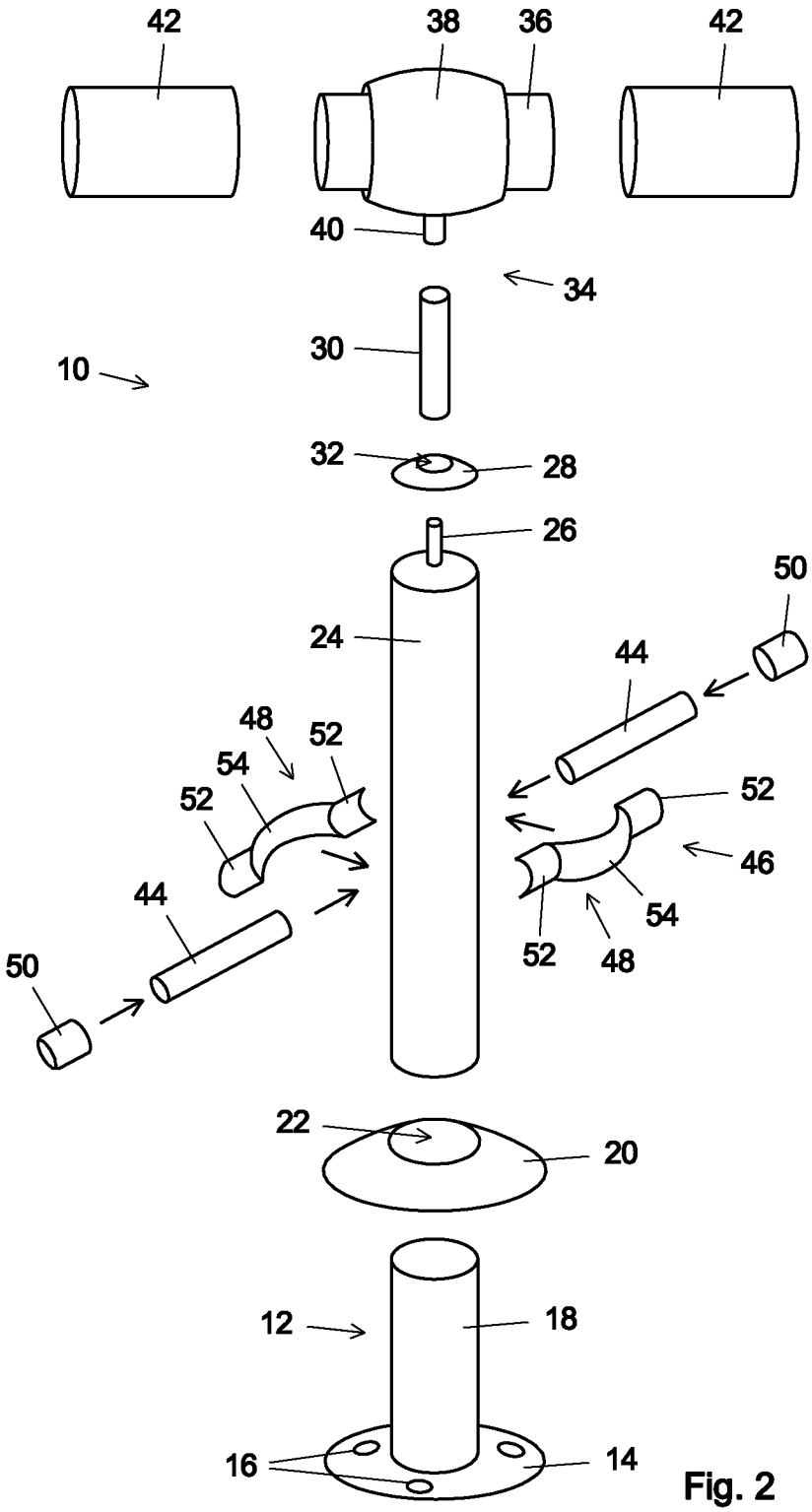
FIG. 2 is an exploded diagrammatic view of part of the balustrade of FIG. 1, with different components of the balustrade viewed from different angles, for clarity.
Figure 3:
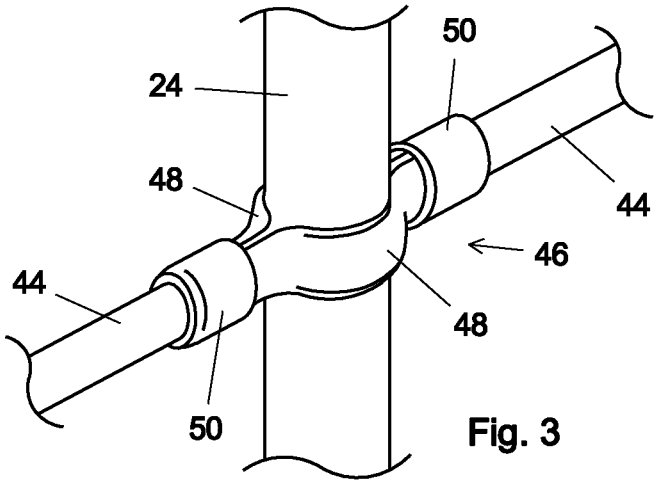
FIG. 3 is a detail isometric view of part of the balustrade of FIG. 1.
Figure 7:
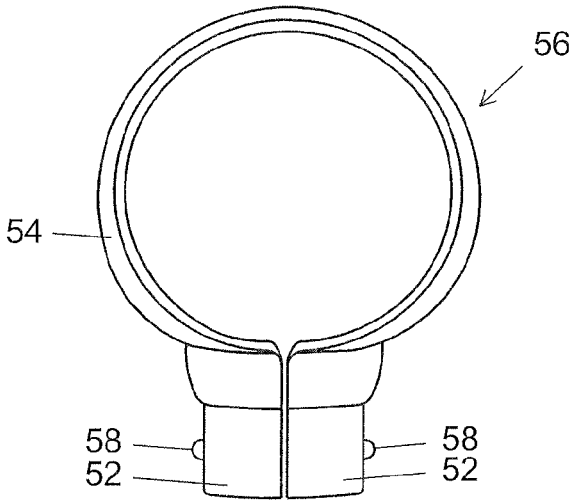
FIG. 7 is a plan view of an end clamp in accordance with the present invention.
Figure 8:
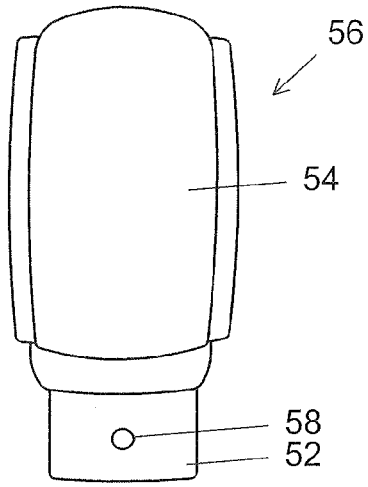
FIG. 8 is a side elevation of the end clamp of FIG. 7.

In instances where a post 24 only needs to be provided with cross bars 44 from one side of the post, e.g. where the post is at a free standing end of a balustrade 10, this can be done by way of an end clamp 56, such as the end clamp shown in FIGS. 7 and 8. The end clamp 56 also has part cylindrical sections 52 at its two ends, shaped and dimensioned to fit around the ends of a cross bar 44 and inside a ring 50 with interference, and has a curved section that is shaped to fit around a post 24, exactly like the corresponding parts of a clamp 48 as shown in FIGS. 1 to 3, except that the curved section 54 of the end clamp 56 extends right around the post 24, so that its part cylindrical sections are fitted on opposing sides of the end of a cross bar 44. Like in the case of the attachment of the cross bars 44 to the posts 24 with the clamps 48, holes can be drilled into the posts 24 for inserting the ends of the cross bars 44 when attaching them to the posts with the clamps 54.

As can also be seen in FIGS. 7 and 8, a protuberance 58 is provided on the outside of each part cylindrical section 52 of the end clamp 56. This is not shown in the embodiment of the invention illustrated in FIG. 2, but similar protuberances can also be provided on the narrow sections 52 of the clamps 48, and/or on the outsides of the joining tubes 36, if desired. Further, the protuberances 58 can have a variety of shapes and/or sizes. The purpose of the protuberances 58 is to increase the interference between the clamp 48,56 and the ring 50, or between the joining tube 36 and the top rail 42, locally in the region of the protuberance and thus to increase the grip between these components. With the increase in the interference fit in the region of the protuberance 58, the interference between the rest of the outer surfaces of the narrow sections 52 and the inner circumferences of the rings 50 need not be as severe to maintain these components in place and accordingly, the forces required to press the rings 50 onto clamps 48,56 with protuberances 58, are less than the forces required in cases where the clamps do not have protuberances, but have tighter circumferential interference. (The same applies in respect of the provision of protuberances on the joining tubes 36 and the interference with which the top rails 42 fit onto them.)

Figure 4:
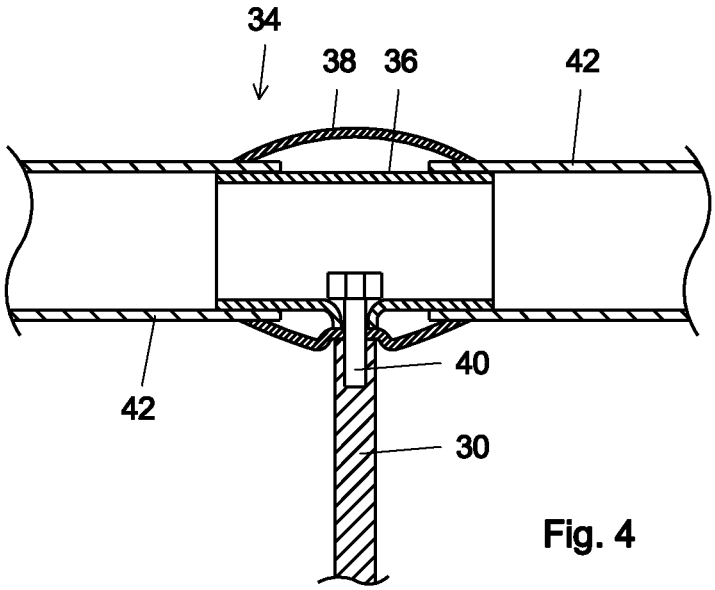
FIG. 4 is a detail sectional view of part of the balustrade of FIG. 1.
Figure 5:
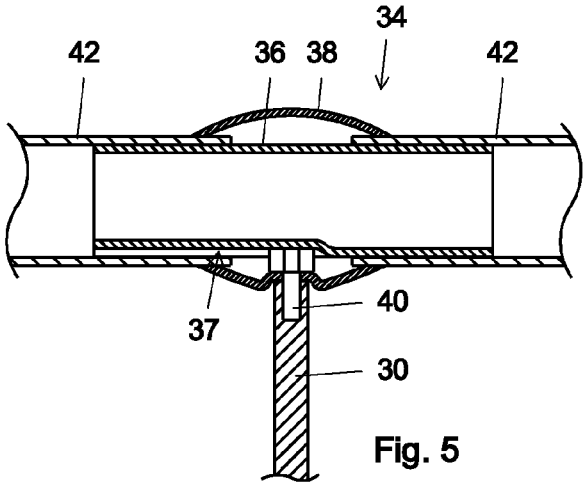
FIG. 5 is a detail sectional view of a second embodiment of the part of the balustrade shown in FIG. 4.

Referring to FIG. 5, a second embodiment of the part of the balustrade 10 is shown, that is an alternative to that shown in FIG. 4. In the embodiment in FIG. 5, a pin 30, bolt 40, housing 38 and top rails 42 are shown, which are identical to those shown in FIG. 4. However, the assembly 34 of attachment formations shown in FIG. 5 includes a joining tube 36 that is significantly longer than the one shown in FIG. 4 and that defines no aperture and dimple through which the bolt 40 can pass, but defines a longitudinal slot 37 extending from its one end.

The assembly 34 shown in FIG. 5 is assembled by attaching the housing 38 to the pin 30 with the bolt 40 and receiving the end of the top rail 42 shown on the left hand side of FIG. 5 inside the housing 38, with a sliding fit. The joining tube 36 is inserted from the right hand side, as shown in FIG. 5, with its slot 37 aligned with the head of the bolt 40 and it is received inside the top rail 42 on the left side, with a press fit. The joining tube 36 is pressed to the left until the head of the bolt 40 is tightly received in the end of the slot 37. The top rail 42 on the right is then installed by sliding it onto the joining tube 36 from the right, with an interference fit, until the end of the right top rail 42 is received with a sliding fit inside the housing 38.

In other embodiments of the assembly 34 (not shown), the housing 38 can be welded to the pin 30. The housing 38 can be shaped with its openings oriented at an angle relative to each other, so that the housing can be used at the top of a post 24 that is situated on a corner of the balustrade. The housing 38 can be shaped in the region of its attachment to the pin 30, so that the pin extends at an angle relative to the housing (whether bolted or welded to the housing), with the result that the top rails will be aligned, but will extend at an angle relative to the pin 30 and thus to the post 24—as is required for top rails 42 of balustrades along stairs.

In any of these embodiments, the housing can be deformed slightly by temporarily inserting a rigid cylindrical bar into the housing 38 through both openings of the housing and tilting the bar. The rigid bar prevents the openings of the housing 38 from deforming and thus allows it to receive the ends of the top rails 42 as described hereinabove.

Figure 6:
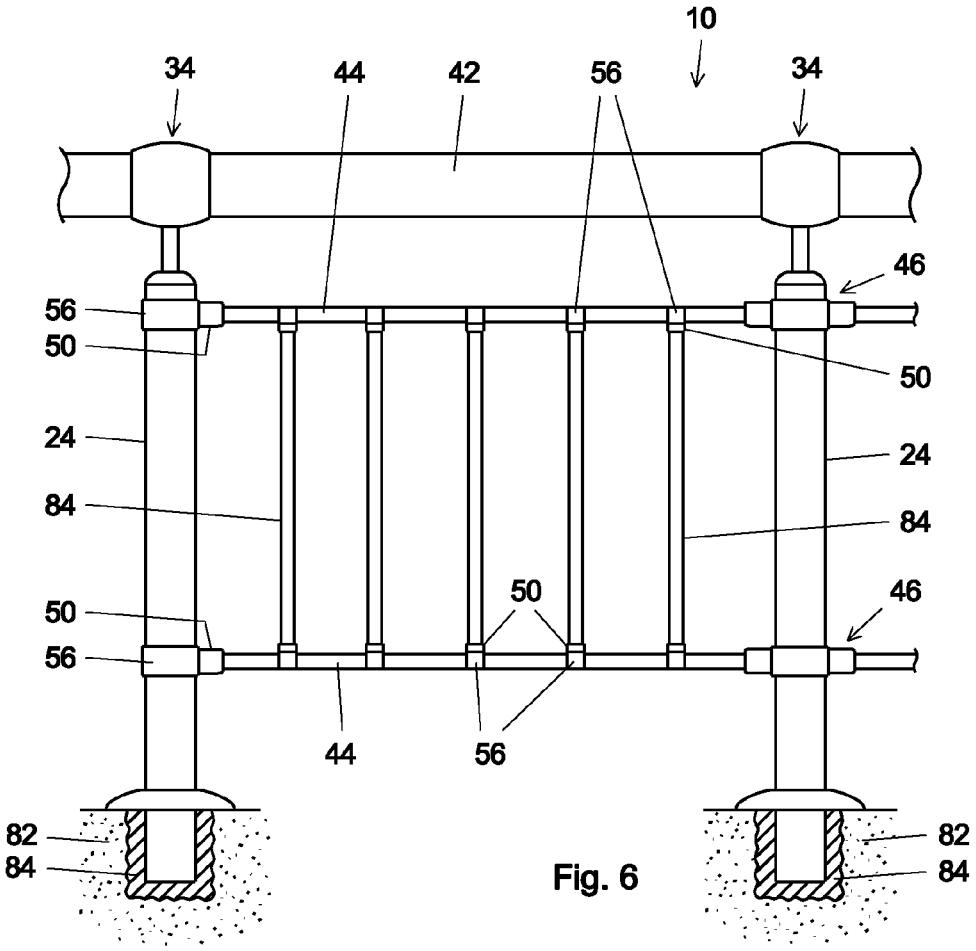
FIG. 6 is a diagrammatic side elevation of a second embodiment of a balustrade in accordance with the present invention.

Referring to FIG. 6, in a second embodiment of a balustrade 10 in accordance with the present invention is shown. The balustrade 10 includes posts 24 that are anchored by inserting their lower ends into holes provided in the substrate 82 and securing it in place with a suitable cement, such as epoxy cement 84. A top rail 42 is fitted with attachment formations 34, as described above and two cross bars 44 are fitted between the posts 24, one above the other, each cross bar attached to the posts with attachment formations 46 as shown in FIG. 3 or with a clamp 56 as shown in FIGS. 7 and 8 and a ring 50. A number of vertical slats 84 are provided between the cross bars 44 and are attached to the cross bars 44 at their top and bottom ends with end clamps 56 and rings 50.

Figure 9:
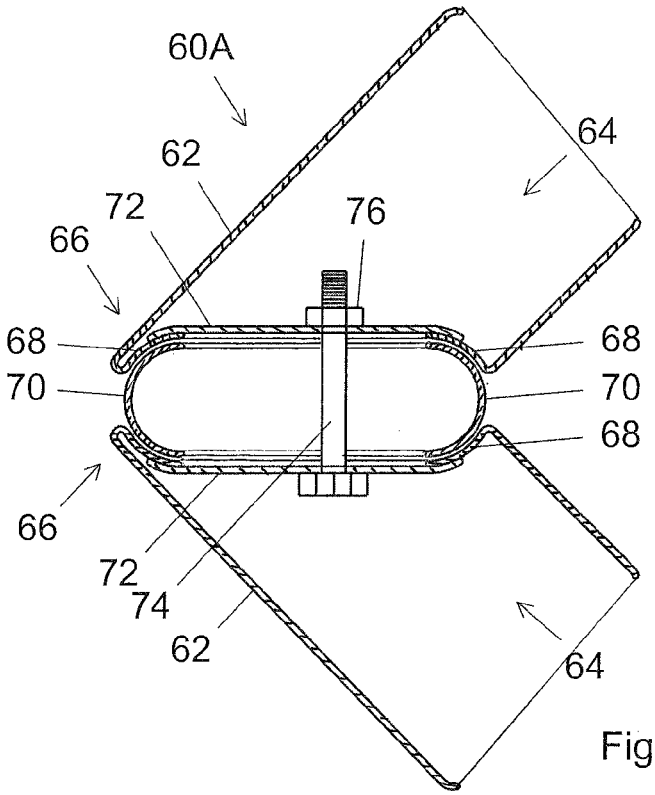
FIG. 9 is a sectional view through a first embodiment of a variable angle joint in accordance with the present invention.
Figure 10:
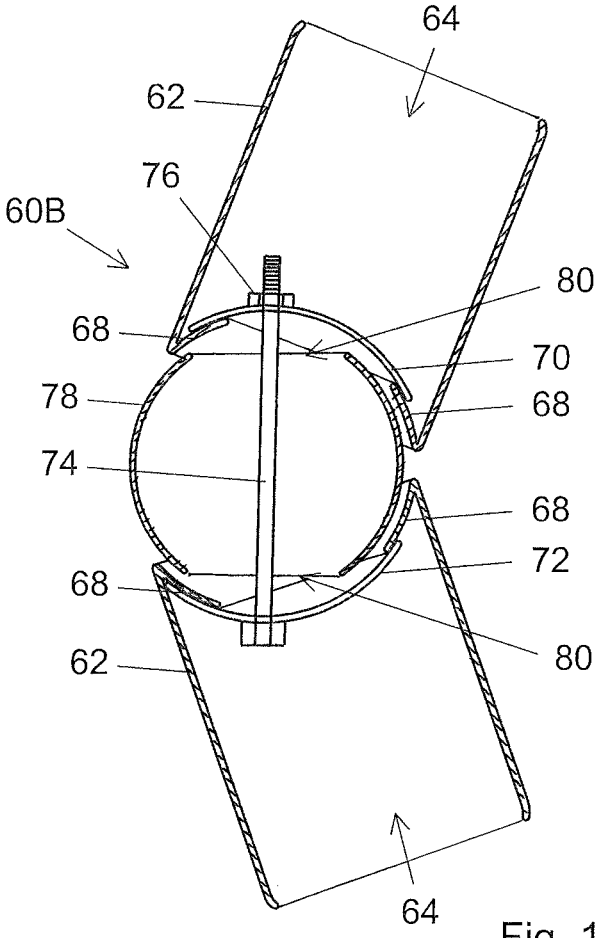
FIG. 10 is a sectional view through a second embodiment of a variable angle joint in accordance with the present invention.

In cases where conventional balustrades need to extend at angles, this is typically done by welding the top rails to posts on site at the desired angles, or by providing posts on opposing sides of the intended corner and making up an angled section of top bar on site, which extends between the posts at the desired angle. However, both these methods require measurement, cutting and welding on site. By contrast, the present invention includes variable angle joints that can be used to connect lengths of the top rail 42 together at various angles. Two embodiments of variable angle joints in accordance with the present invention are shown in FIGS. 9 and 10, respectively, and are generally indicated by reference numerals 60A and 60B. Features that are common between the joints are indicated by the same reference numerals.

Referring to FIG. 9, the variable angle joint 60A includes two short cylindrical sockets 62, each with an open end 64 and an angled end 66. Around the periphery of its angled end 66, each socket 62 forms a concave, recessed lip 68 and a ring 70 with a semi-circular cross sectional profile fits snugly inside the recesses formed by the lips 68. A washer 72 is fitted inside each socket 62 with its periphery against the lip 86 and a bolt 74 extends through the washers and is provided with a nut 76. When the nut 76 is loose, the nut and bolt 74 holds the components of the joint 60A loosely in place, so that each socket 62 can rotate about the axis of the bolt and can move about generally, relative to the ring 70. The angled orientation of each socket 62 relative to the rotational axis of the bolt 74, allows the relative angle between the sockets to be changed, as they are rotated about the bolt and the general play between the components, together with the recessed shapes of the lips 68 and the rounded shape of the ring 70 allow the relative orientation between the sockets 62 to be varied through small angles. When the nut 76 is tightened, it presses the washers 72, which hold the angled ends of the sockets 62 firmly in place, with their lips 68 pressed against the ring 70.

When a balustrade 10 is being installed and needs to form a corner, the angle at which the top rails 42 extending on each side of the corner need to intersect is determined. The sockets 62 of the joint 60A are rotated and or shifted as allowed by the play between the components until they are oriented at the correct angle and the nut 76 is tightened through the open end 64. The ends of the top rails 42 extending from opposite sides of the corner are received inside the open ends 64 of the sockets 62 with interference fits, with the result that the top rails are fixedly joined by the joint 60A at the desired angle.

Referring to FIG. 10, the variable angle joint 60B also includes two short cylindrical sockets 62, each with an open end 64. At the end of each socket, opposite from its open end 64, it has a concave, recessed lip 68 around its circumference and washers 72 are provided inside the sockets 62, adjacent the lips 68 and are held in place by a nut 76 and bolt 74. A hollow spherical formation 78 is provided, which defines two large apertures 80 through which the bolt 74 extends with clearance.

The joint 60B is used in much the same way as the joint 60A, except that when the nut 76 is loose, the sockets 62 are moved relative to each other by sliding them around the circumference of the spherical formation 78. The sockets 62 are also locked in a desired angular orientation by tightening the nut 76 and the joint 60B is fitted to the ends of angled top rails 42 by receiving the ends inside the open ends 64 of the sockets with an interference fit. The difference between the joints 60A and 60B is that the outer surface of the ring 70 is not spherical and the freedom of movement in this joint is more restricted than in the joint 60B, where the spherical shape of the formation 80 allows much more freedom of movement of the sockets 62 relative to the formation.

All the components of the balustrade 10 described herein above are made of a suitably durable and resilient material, such as stainless steel. All the welding operations that are required can be performed off site, before assembly on site and the only operations that are required when the balustrade 10 is installed on site, are attaching the posts 24 to the substrate, assembly of the components and optionally, the cutting of one or more of the posts 24 to compensate for an uneven substrate or cutting of cross bars 44 and/or top rails 42 to length.

All the components of the balustrade can thus be finished off site, where finishing operations can be achieved much more effectively and efficiently. In particular, the off site finishing of the components can be automated and thus be done very precisely and cost effectively. This is particularly true in the case of polishing of stainless steel components, which enhances the appearance of the balustrade 10, and inhibits corrosion.

It has been mentioned that one or more of the posts 24 can optionally be cut on site to shorten it, but the lower ends of these components are all covered by the cover plates 20, so that minor markings that may result from cutting operations on site will not be visible. Likewise, the ends of the cross bars 44 are covered by the clamps 48,56 and the ends of the top rails 42 are covered by the housings 38 (or sockets 62 in the case of corners).

The strength of the balustrade 10 will depend to a large extent on the press fits between the various components, but since the components can be manufactured off site, their manufacture can be automated, thus ensuring accurate interference in the press fits and keeping costs down.

The assembly of the balustrade 10 on site requires very little skill and the only specialised equipment that will be required will be a press that can press the components together in each instance that there is a press fit. This can be done with a portable hydraulic press with suitable attachments for gripping the components of the balustrade without damaging them or their finishes. The result is that balustrades 10 can be supplied in kit form to artisans who are trained and equipped with basic tools and a suitable press, to manufacture the balustrade on site without any welding or drilling of the components of the balustrade on site.

The invention claimed is:

1. A method of manufacturing a balustrade, said method comprising:

providing a plurality of posts;

attaching the posts to a substrate, each with an upright orientation;

assembling attachment formations and attaching them to the upper end of each post; and installing at least one top rail by attaching it to the attachment formations by receiving a lateral protuberance of the attachment formations inside a recess defined in an end of the top rail, with a press-fit;

wherein the attachment formations include an upward protuberance extending upwards from the upper end of the post, the lateral protuberance is part of a tube that has at least one longitudinal slot in a lower portion thereof, said slot extending from one end of the tube and forming a blind end intermediate the ends of the tube and the step of assembling the attachment formations includes receiving the upward protuberance in the slot, at least in part, by sliding it longitudinally along the slot from the end of the tube, until the upward protuberance is tightly received in the end of the slot.

2. A method as claimed in claim 1, wherein the attachment formations include a housing extending around the tube with clearance and the step of installing the top rail includes receiving the end of the top rail in the clearance inside the housing.

3. A balustrade, which comprises:

a plurality of upstanding posts;

at least one top rail extending between the posts; and attachment formations attached to the upper end of each post;

wherein the top rail is attached to the attachment formations by a lateral protuberance of the attachment formations that extends into a recess defined in an end of the top rail, with a press fit; and wherein the attachment formations include an upward protuberance extending upwards from the upper end of the post, the lateral protuberance is the end of a hollow tube that has at least one longitudinal slot in a lower portion thereof, said slot extending from the lateral protuberance and forming a blind end intermediate the ends of the tube and the upward protuberance is received in the slot, at least in part, by sliding it longitudinally along the slot from the lateral protuberance, until the upward protuberance is tightly received in the blind end of the slot.

4. A balustrade as claimed in claim 3, wherein the attachment formations include a housing extending around the tube with clearance and the end of the top rail extends into the clearance inside the housing.

* * * * *